US008155576B2

(12) United States Patent
Kato et al.

(10) Patent No.: US 8,155,576 B2
(45) Date of Patent: Apr. 10, 2012

(54) SHEET PROCESSING APPARATUS AND IMAGE FORMING APPARATUS

(75) Inventors: Daijiro Kato, Abiko (JP); Katsuaki Hirai, Moriya (JP); Takeshi Aoyama, Abiko (JP); Masahiro Funakoshi, Toride (JP); Shoko Magata, Toride (JP); Yuichi Yamamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 921 days.

(21) Appl. No.: 12/127,367

(22) Filed: May 27, 2008

(65) Prior Publication Data

US 2008/0296825 A1 Dec. 4, 2008

(30) Foreign Application Priority Data

May 30, 2007 (JP) ..... 2007-142897
May 20, 2008 (JP) ..... 2008-131448

(51) Int. Cl.
*G03G 15/00* (2006.01)
*B65H 37/04* (2006.01)

(52) U.S. Cl. ..... 399/408; 399/407; 412/8; 412/22; 412/33; 412/37; 156/60; 492/13

(58) Field of Classification Search ..... 399/407, 399/408
See application file for complete search history.

(56) References Cited

U.S. PATENT DOCUMENTS 2,225,229 A * 12/1940 Neuwirth ..... 156/389
4,806,194 A * 2/1989 Wald ..... 156/379.8
4,993,076 A * 2/1991 Dierickx ..... 2/463
5,108,244 A * 4/1992 Bellanca ..... 412/37
5,846,175 A * 12/1998 Chen ..... 492/13
6,641,345 B2 * 11/2003 Cobene et al. ..... 412/1
6,717,286 B2 * 4/2004 Tsuchiya et al. ..... 270/58.07
7,380,779 B2 6/2008 Nakamura et al. ..... 270/58.25
7,401,989 B2 * 7/2008 Silverbrook ..... 400/149
2005/0084308 A1 4/2005 Nakamura et al. ..... 399/407
2005/0206069 A1 9/2005 Yamamoto ..... 271/117
2006/0018695 A1 1/2006 Hirai ..... 399/407
2007/0082560 A1 * 4/2007 Acher ..... 439/845
2008/0024811 A1 1/2008 Nakamura et al. ..... 358/1.13

FOREIGN PATENT DOCUMENTS

JP 01145978 A * 6/1989
JP 08310716 A * 11/1996
JP 2000-43445 2/2000
JP 2000318345 A * 11/2000
JP 2002283769 A * 10/2002
SU 638497 A * 12/1978

* cited by examiner

*Primary Examiner* — Judy Nguyen
*Assistant Examiner* — Nguyen Q Ha
(74) *Attorney, Agent, or Firm* — Fitzpatrick, Cella, Harper & Scinto

(57) ABSTRACT

The invention is to provide a miniaturized sheet processing apparatus in that a conveying length a conveying distance need not be increased even though the number of sheets per bundle increases. A glue applying bookbinder that partially glues sheets and performs a pressing process to form a sheet bundle. The glue applying bookbinder includes a processing tray that stacks sheets, a glue applying portion that applies a glue on the sheets on the processing tray, and pressing portions that press the sheets on the processing tray. The glue applying portion is arranged such that the glue applying portion can be moved from a first standby position outside the sheets stacked on the stacking portion to a second standby position, different from the first standby position, outside the sheets through an upper surface of the sheets, and the pressing portions are moved integrally with the glue applying portion.

14 Claims, 14 Drawing Sheets

SHEET PROCESSING APPARATUS AND IMAGE FORMING APPARATUS

BACKGROUND OF THE INVENTION

1. Field of the Invention

The present invention relates to a sheet processing apparatus and a sheet processing apparatus that glues parts of sheets and pressing process to the sheets to form a sheet bundle.

2. Description of the Related Art

A conventional sheet processing apparatus that glues parts of sheets and presses the sheets to form a sheet bundle is proposed. For example, in Japanese Patent Application Laid-Open No. 2000-43445, a manufacturing method that collates a plurality of sheets and staples the sheets with a glue is disclosed. The apparatus disclosed in Japanese Patent Application Laid-Open No. 2000-43445 includes a plurality of collating devices to collate sheets and a plurality of glue applying devices to staple the collated sheets on a conveying belt to convey the sheets. In order to sequentially collate the sheets to staple the sheets, conveying, glue applying, and pressing are repeated to form a sheet bundle.

However, in Japanese Patent Application Laid-Open No. 2000-43445, as described above, a sheet bundle is formed by repeating conveying, glue applying, and pressing. When the number of sheets of one bundle increases, the numbers of collating and glue applying devices on the convey belt must be increased. For this reason, a conveying distance becomes long to cause an increase in size of the apparatus.

SUMMARY OF THE INVENTION

The present invention is to provide a miniaturized sheet processing apparatus in that a conveying distance need not be increased even though the number of sheets of one bundle increases.

A typical configuration of the present invention is a sheet processing apparatus including: a stacking portion on that sheets are stacked; a glue applying portion that applies a glue on a bonding part of sheets on the stacking portion; and a pressing portion that presses the bonding part, wherein the pressing portion presses the bonding part while moving, and the glue applying portion applies a glue while moving integrally with the pressing portion.

According to the present invention, a glue is applied to sheets on the stacking portion while the glue applying portion and the pressing portion are integrally moved to form a sheet bundle. For this reason, even though the number of sheets per bundle increases, a conveying distance need not be increased, and a miniaturized sheet processing apparatus can be provided.

Further features of the present invention will become apparent from the following description of exemplary embodiments with reference to the attached drawings.

BRIEF DESCRIPTION OF THE DRAWINGS

FIGS. 6A and 6B are diagrams for explaining an operation (state in which a plurality of sheets are stacked) of the sheet aligning device, in which FIG. 6A is a front view of the sheet aligning device and FIG. 6B is a diagram of the sheet aligning device when viewed from a direction of an arrow X in FIG. 6A.

FIGS. 7A and 7B are diagrams for explaining an operation (state in which a knurling belt is transformed to a retreat position where the knurling belt does not in contact with a sheet), in which FIG. 7A is a front view of the sheet aligning device and FIG. 7B is a diagram of the sheet aligning device when viewed from a direction of an arrow x.

DESCRIPTION OF THE EMBODIMENTS

Preferable embodiments of the present invention will be illustratively described below with reference to the accompanying drawings. However, sizes, materials, shapes, and a relative arrangement of constituent elements described in the following embodiments should be arbitrarily changed depending on the configuration and various conditions of apparatuses to which the present invention is applied. Therefore, unless otherwise noted, the spirit and scope of the invention are not limited to only the embodiments.

Figure 1:
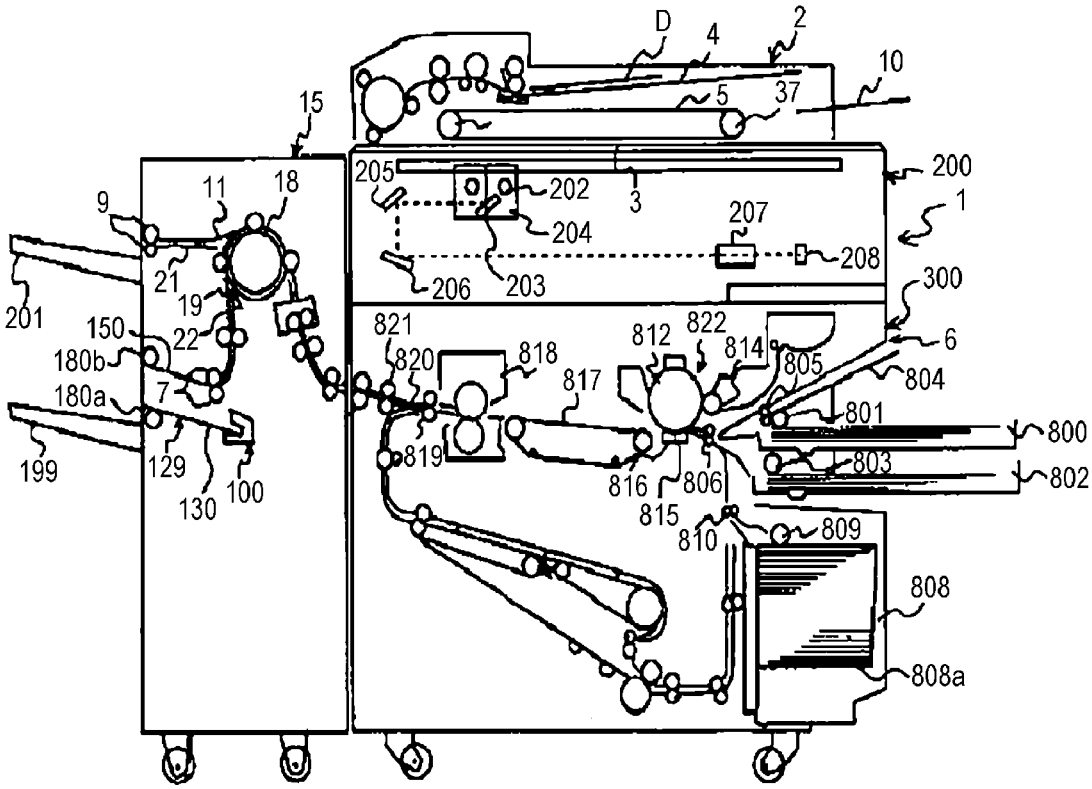
FIG. 1 is a schematic sectional view of an image forming apparatus having a glue applying bookbinder.
Figure 2:
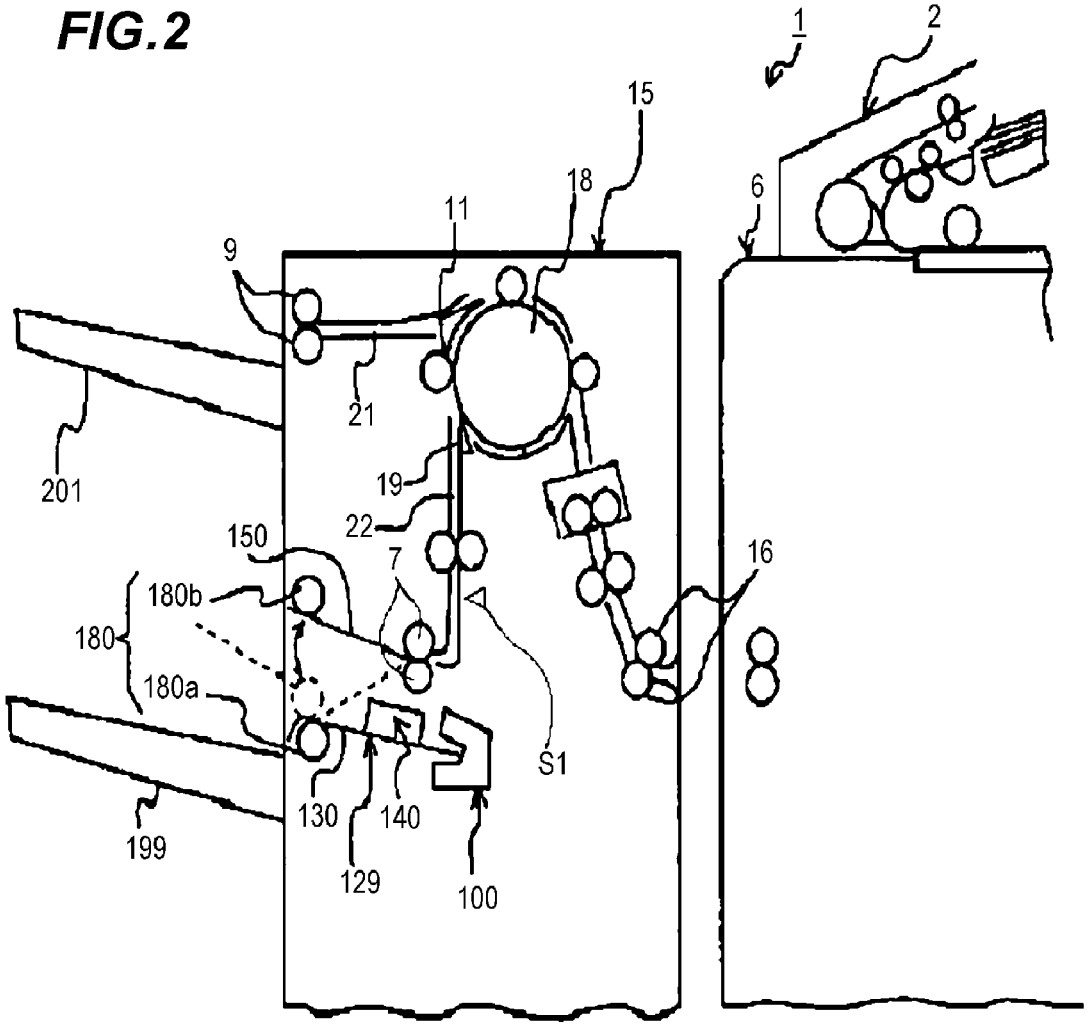
FIG. 2 is a schematic sectional view of the glue applying bookbinder.

An image forming apparatus having a glue applying bookbinder serving as a sheet processing apparatus will be described below with reference to FIGS. 1 and 2. FIG. 1 is a typical sectional view illustrating a schematic configuration of an image forming apparatus having a glue applying bookbinder. In this case, a copying machine is illustrated as the image forming apparatus. FIG. 2 is a typical sectional view illustrating a schematic configuration of the glue applying bookbinder.

In FIGS. 1 and 2, an image forming apparatus 1 includes an original conveying device (ADF) 2, a reader portion 200, a printer portion 300, a glue applying bookbinder 15 having a sheet aligning device 129, and the like.

The original conveying device 2 has an original tray 4 arranged thereabove, and a broad belt 5 winded on a drive roller 36 and a turn roller 37. An original D on the original tray 4 is sequentially separated and fed from the uppermost sheet by a separation portion and then conveyed onto a platen glass 3 at a read position of a main body 6 of the image forming apparatus 1.

The broad belt 5 abuts on an upper surface of the platen glass 3 such that the broad belt 5 can be freely rotated forward or backward. The broad belt 5 conveys the original D conveyed from the original tray 4 to a predetermined position of the platen glass 3, and conveyed out on an original discharge tray 10. The original D is stacked on the original tray 4 from above in the order named: page 1 (page 2), page 3 (page 4), . . . .

The main body 6 of the image forming apparatus 1 includes the reader portion 200 and the printer portion 300. The reader portion 200 has the platen glass 3, a scanner unit 204, mirrors 205 and 206, a lens 207, and an image sensor 208. An image recorded on the original D is optically read and photoelectrically converted into image data, and the image data is input to the printer portion 300. The scanner unit 204 has a lamp 202 and a mirror 203.

The printer portion 300 will be described below. The printer portion 300 is designed to copy an original image on a sheet by a known electrostatic latent image scheme. The printer portion 300 is also designed to form an image on a sheet by an external information signal.

An upper cassette 800 stores sheets. The sheets in the upper cassette 800 are separately fed one by one to a pair of registration rollers 806 by a separation claw (not shown) and a feeding roller 801. A lower cassette 802 also stores sheets. The sheets in the lower cassette 802 are separately fed one by one to the pair of registration rollers 806 by the separation claw (not shown) and a feeding roller 803. The manual feed guide 804 is designed to supply a sheet by a manual feed operation by a user. The sheet supplied to the manual feed guide 804 is fed to the pair of registration rollers 806 by a roller 805. A deck-type sheet stacking device 808 includes an intermediate plate 808*a* vertically moved by a motor or the like. Sheets on the intermediate plate 808*a* are separately fed one by one to the pair of registration rollers 806 by a pair of feeding rollers 809 and a separation claw (not shown) through a conveying roller 810.

One original stacked on the platen glass 3 is read by the reader portion 200. On the basis of the read original information, an electrostatic latent image is formed on a photosensitive drum 812 by a write optical system (not shown). Each time a toner image is formed on the photosensitive drum 812 by a development device 814, a predetermined number of sheets the number of which is set by a user are fed from any one of the cassettes 800 and 802, the sheet stacking device 808, and the manual feed guide 804 to the photosensitive drum 812. Alignment between the image on the photosensitive drum 812 and the sheet is performed by the pair of registration rollers 806.

When images are formed on a required number of sheets, the originals are discharged from the platen glass 3, and the next original is positioned on the platen glass 3. The image forming apparatus 1 will copy the image of the original on sheets by the same manner as described above.

When a sheet is supplied from any one of the cassettes 800 and 802, the sheet stacking device 808, and the manual feed guide 804 to the photosensitive drum 812, a toner image on the photosensitive drum 812 is transferred to the sheet by a transfer charger 815. The toner image is formed on the photosensitive drum 812 by the development device 814 in advance. The sheet is separated from the photosensitive drum 812 by a separating charger 816. The photosensitive drum 812, the development device 814, the transfer charger 815, the separating charger 816, and the like constitute an image forming portion 822.

The sheet on which the toner image is formed is conveyed to a fixing device 818 by a conveying belt 817. The fixing device 818 heats and presses the sheet to fix the toner image on the sheet. Thereafter, a conveying roller 819 feeds the sheet on which the toner image is fixed to a switching member 820. The switching member 820 guides the sheet on which the toner image is fixed to a main-body discharge roller 821 and guides the sheet to the glue applying bookbinder 15.

Figure 3:
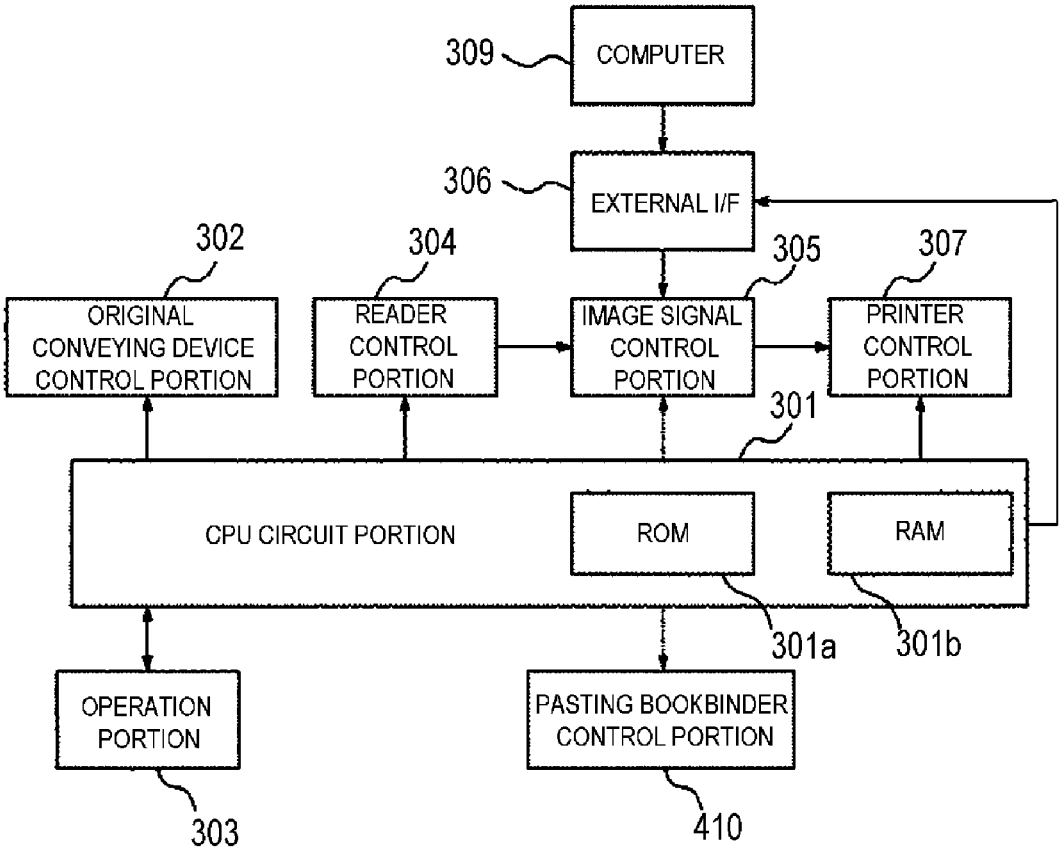
FIG. 3 is a block diagram illustrating a controller configuration that controls an entire image forming apparatus.

A configuration of a controller that controls an entire image forming apparatus will be described below. FIG. 3 is a block diagram illustrating the configuration of the controller that controls the entire image forming apparatus in FIG. 1.

The controller, as shown in FIG. 3, has a CPU circuit portion 301. The CPU circuit portion 301 incorporates a CPU (not shown), a ROM 301*a*, and a RAM 301*b* and integrally controls blocks 302, 303, 304, 305, 306, 307, and 410 by a control program stored in the ROM 301*a*. A RAM 152 temporarily holds control data and can be used as a work area for an arithmetic process based on the control.

The original conveying device control portion 302 drives and controls the original conveying device 2 on the basis of an instruction from the CPU circuit portion 301. The reader control portion 304 drives and controls the scanner unit 204, the image sensor 208, and the like and transfers an analog image signal output from the image sensor 208 to the image signal control portion 305.

The image signal control portion 305 converts the analog image signal from the image sensor 208 into a digital signal, performs processes to the digital signal, and converts the digital signal into a video signal to output the video signal to the printer control portion 307. The image signal control portion 305 performs processes to a digital image signal input from a computer 309 via an external I/F 306, and converts the digital image signal into a video signal to output the video signal to the printer control portion 307. The processing operation performed by the image signal control portion 305 is controlled by the CPU circuit portion 301. The printer control portion 307 drives the image forming portion 822 described above on the basis of the input video signal.

The operation portion 303 has a plurality of keys that set various functions related to image formation, a display portion to display information representing a set state, and the like. The operation portion 303 outputs a key signal corresponding to an operation of each of the keys to the CPU circuit portion 301 and displays the corresponding information on the display portion on the basis of a signal from the CPU circuit portion 301.

The glue applying bookbinder control portion 410 is mounted on the glue applying bookbinder 15 and exchanges information with the CPU circuit portion 301 to entirely drive and control the glue applying bookbinder 15. The contents of the control will be described later.

In FIG. 2, a flow of a sheet in a non-sort mode will be described below. The sheet conveyed from the main body 6 of the image forming apparatus 1 into the glue applying bookbinder 15 is discharged to a sample tray 201 by a second pair of discharge rollers 9 through a pair of inlet rollers 16, a buffer roller 18, a first switching member 11, and a non-sort-mode path 21. In the sort mode, the sheets are sequentially temporarily stacked on a processing tray 130 serving as an intermediate tray by a first pair of discharge rollers 7 serving as a conveying portion through the pair of inlet rollers 16, the buffer roller 18, a second switching member 19, and a sort-mode path 22.

The processing tray 130 is a sheet stacking portion that stacks a sheet. The sheet on the processing tray 130 is aligned in a sheet width direction by aligning plate 140 and aligned in a sheet conveying direction by a knurling belt 190 (will be described later) or the like. Furthermore, sheets to be sequentially stacked are partially glued and pressed at a bonding part by a glue applying and pressing unit 100 (will be described later) to form a sheet bundle. The sheet bundle formed as described above is discharged onto a stack tray 199.

The sheet aligning device 129 will be described below with reference to FIGS. 4 to 8. The sheet aligning device 129 includes the first pair of discharge rollers 7, the knurling belt 190, the processing tray 130, a lead-in paddle 160, a rear-end stopper member 131, a width aligning device 140, a floating roller 191, an oscillating guide 150, and a pair of bundle discharge rollers 180. The first pair of discharge rollers 7 includes a discharge roller 7*a* and a discharge roller 7*b*. Knurls (coarse surface) are formed on the circumference of the knurling belt 190. The floating roller 191 is connected to a tractive actuator M192 and engaged with the knurling belt 190.

The processing tray 130 serving as a sheet stacking portion is obliquely arranged such that an upstream side (left side in the drawings) faces upward with respect to a discharge direction of the sheet bundle and a downstream side (right side in the drawings) faces downward. On the discharge roller 7*a* above the upstream-side end of the processing tray 130, a plurality of knurling belts 190 are arranged at predetermined intervals in a sheet width direction. Sheet guides 130*d* are positioned between the knurling belts 190. Near the upstream-side end of the processing tray 130, the rear-end stopper member 131 is arranged. Furthermore, at an intermediate portion of the processing tray 130, the width aligning device 140 that aligns the widths (direction crossing the sheet conveying direction) of the sheets at positions corresponding to both the left and right sides of a sheet P is arranged. Above the downstream side of the processing tray 130, the lead-in paddle 160 (will be described later) and the oscillating guide 150 having an upper bundle discharge roller 180*b*.

Figure 4:
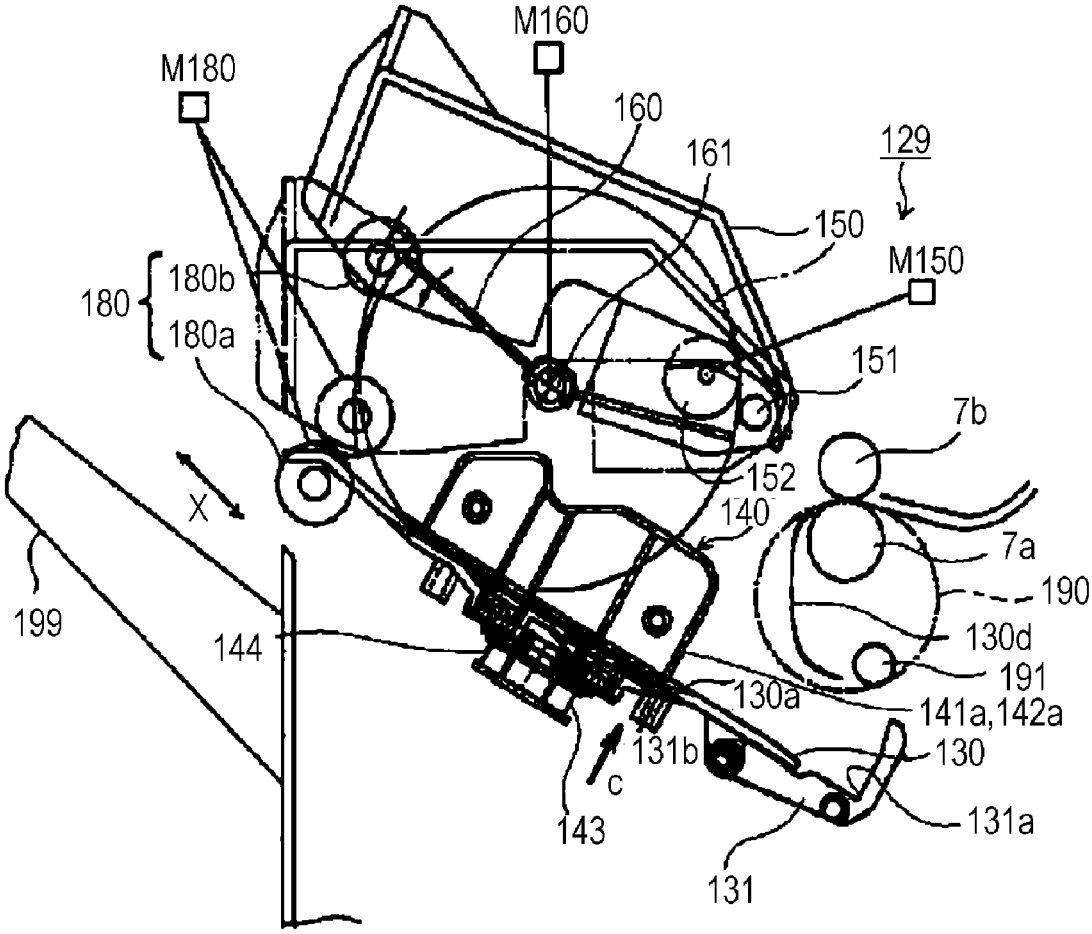
FIG. 4 is a schematic sectional view of a sheet aligning device.
Figure 5:
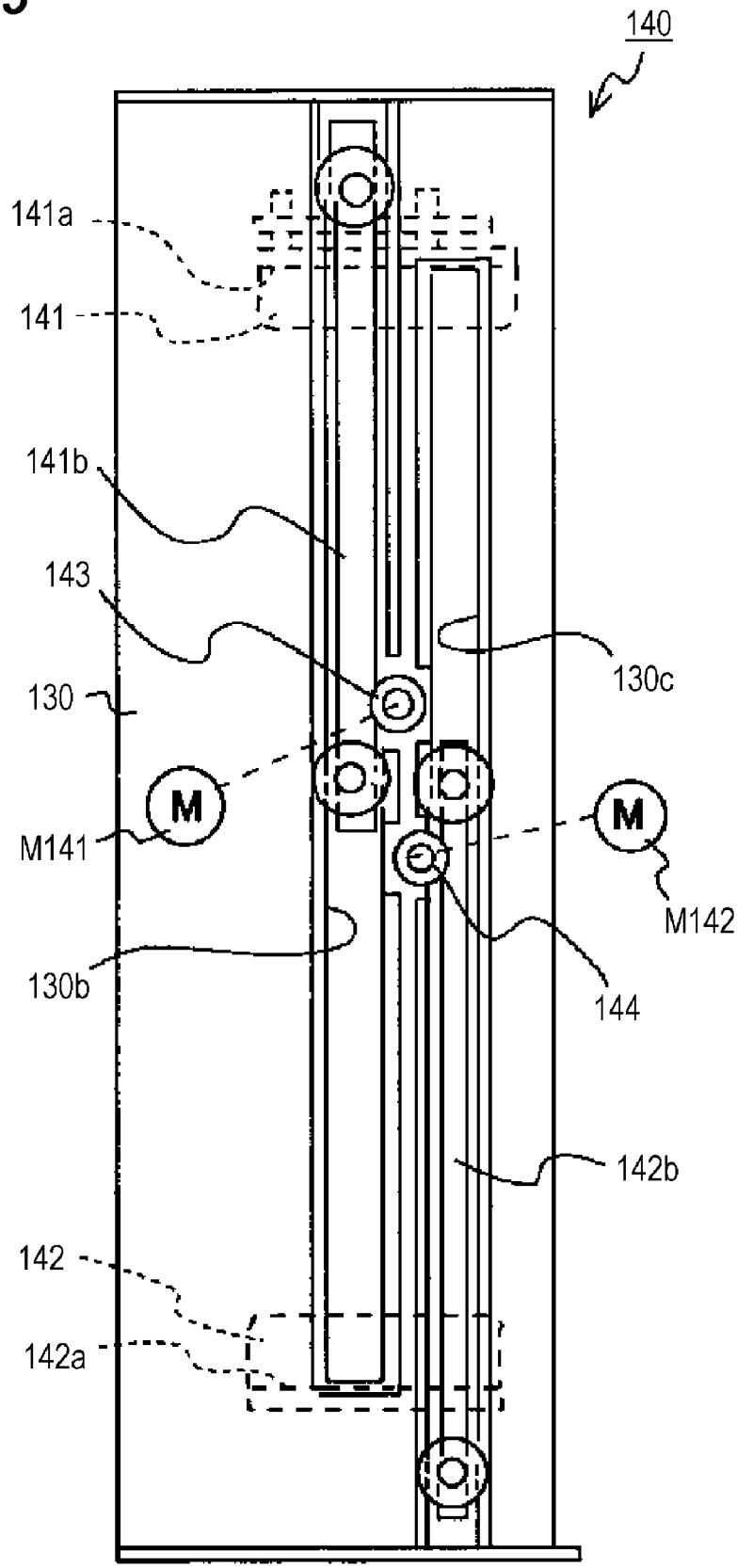
FIG. 5 is a diagram of the sheet aligning device when viewed from a direction of an arrow c in FIG. 4.

In FIG. 5 obtained when viewed from a direction of arrow C in FIG. 4, the width aligning device 140 includes one pair of first and second aligning members 141 and 142 arranged to oppose both sides of the processing tray 130. The first and second aligning members 141 and 142 have aligning surfaces 141*a* and 142*a* which press both the sides of the sheet to align the width of the sheet and which are vertical to an upper surface 130*a* of the processing tray 130, and racks 141*b* and 142*b* to support the rear surface of the sheet, respectively. The racks 141*b* and 142*b* project on the lower-surface side through a pair of guide holes 130*b* and 130*c* formed to extend from the processing tray 130 in the width direction of the sheet P.

The aligning surfaces 141*a* and 142*a* face each other on the upper surface 130*a* side of the processing tray 130. On the lower-surface side of the processing tray 130, the racks 141*b* and 142*b* are incorporated to enable the racks 141*b* and 142*b* to move in the width direction of the sheet (sheet aligning direction).

Pinions 143 and 144 arranged on the lower portion of the processing tray 130 are meshed with the racks 141*b* and 142*b*, respectively. The pinions 143 and 144 are designed to be rotated forward or backward by a first aligning motor M141 and a second aligning motor M142, respectively. When the pinions 143 and 144 are rotated forward or backward by the first aligning motor M141 and the second aligning motor M142, respectively, the first and second aligning members 141 and 142 move in the aligning directions, respectively. For the first and second aligning members 141 and 142, position sensors (not shown) that detect home positions of the first and second aligning members 141 and 142, respectively. In general, the first and second aligning members 141 and 142, as shown in FIG. 5, are standby at the home positions which are furthest from each other.

In FIG. 4, the oscillating guide 150 supports the upper bundle discharge roller 180*b* which abuts on the lower bundle discharge roller 180*a* of the pair of bundle discharge rollers 180 and is oscillatorily supported by a support shaft 151. The oscillating guide 150 is designed to be oscillated by rotation of a rotating cum 152 rotated by an oscillating motor M150. The home position of the oscillating guide 150 is a position of a closed state in which the upper bundle discharge roller 180*b* abuts on the lower bundle discharge roller 180*a*. A position sensor (not shown) detects whether the oscillating guide 150 is at the home position.

When the sheet P is discharged onto the processing tray 130, the oscillating guide 150 is lifted up by the rotation of the rotating cum 152. In this manner, an opened state in which the upper bundle discharge roller 180*b* is separated from the lower bundle discharge roller 180*a* to prevent a tractive paddle operation (will be described later) from being disturbed. When a sheet bundle the aligning process of which is completed on the processing tray 130 is discharged onto the stack tray 199, the oscillating guide 150 oscillates downward to cause the upper bundle discharge roller 180*b* to press the sheet bundle against the lower bundle discharge roller 180*a* so as to set the closed state.

Figure 6A:
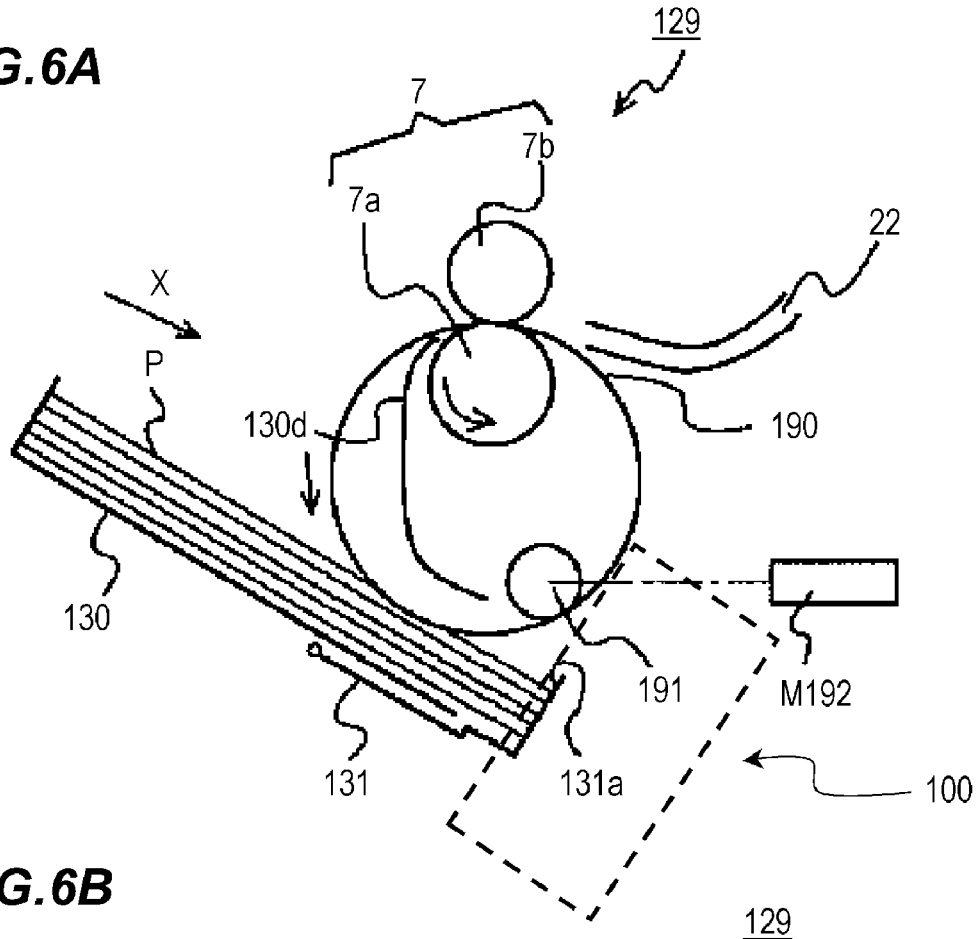
Figure 6B:
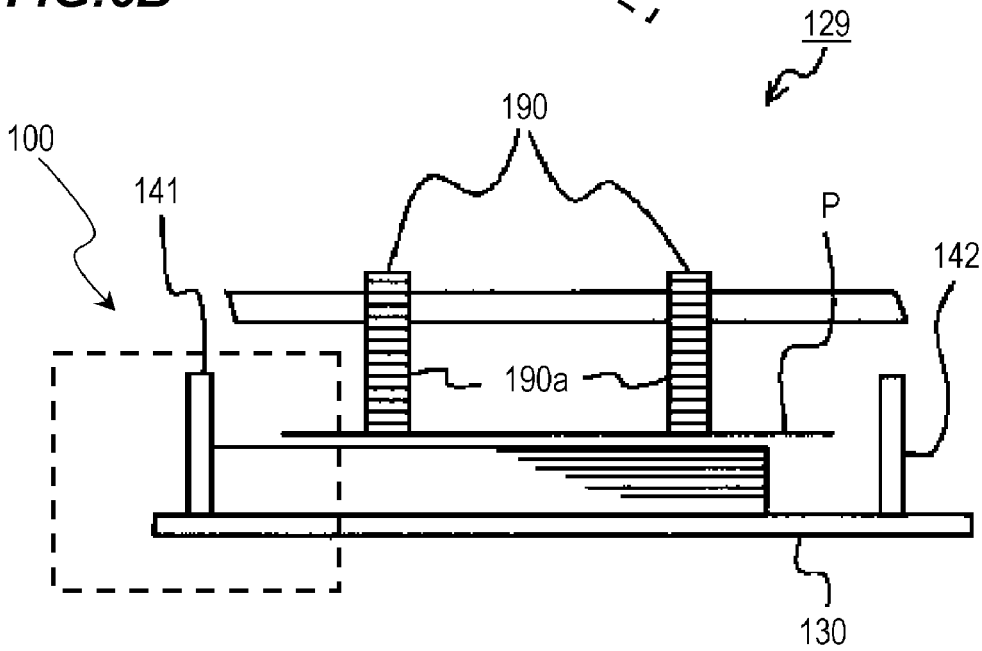
Figure 7A:
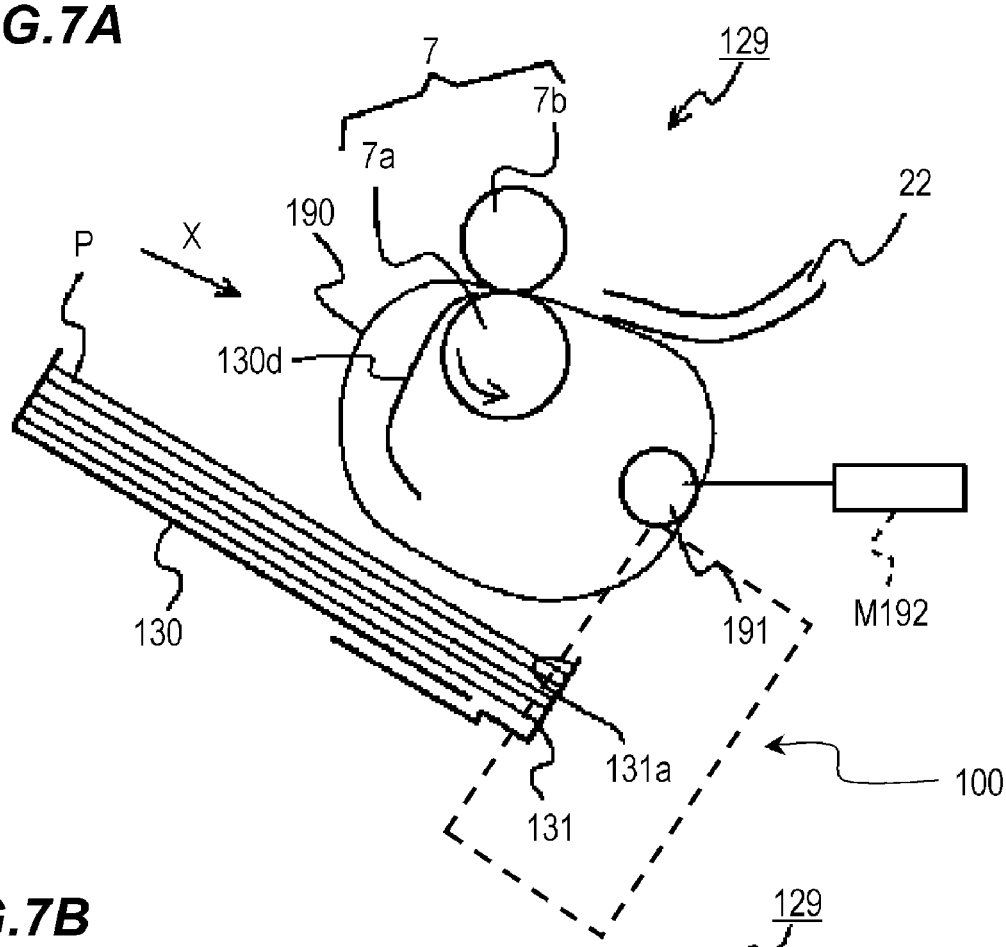
Figure 7B:
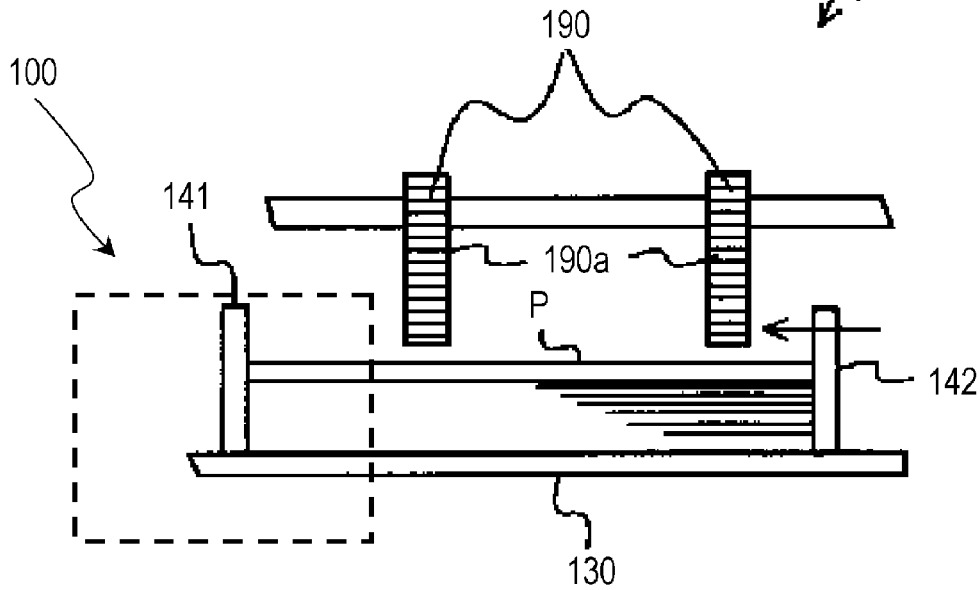
Figure 8:
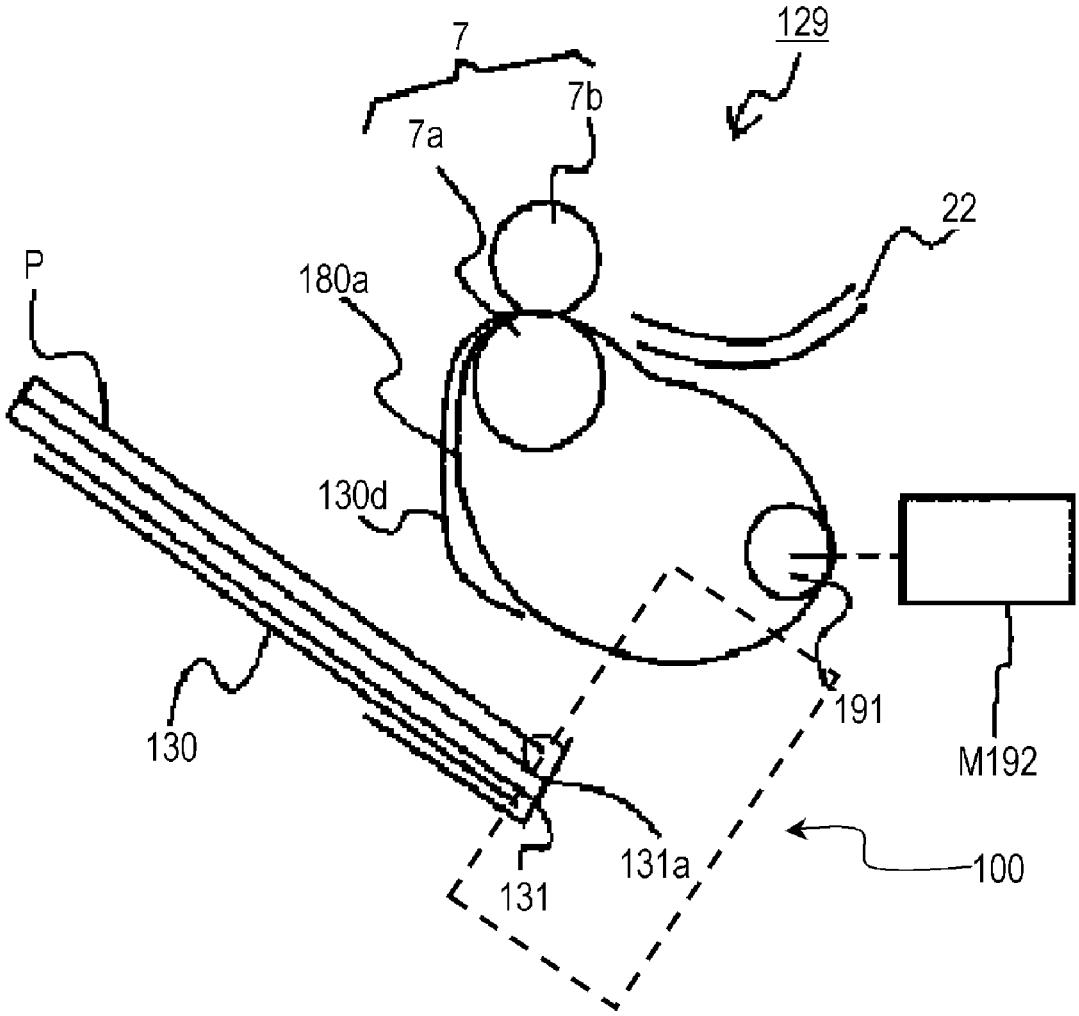
FIG. 8 is a diagram for explaining an operation (state in which the knurling belt is pulled to a bundle discharge position).
Figure 9:
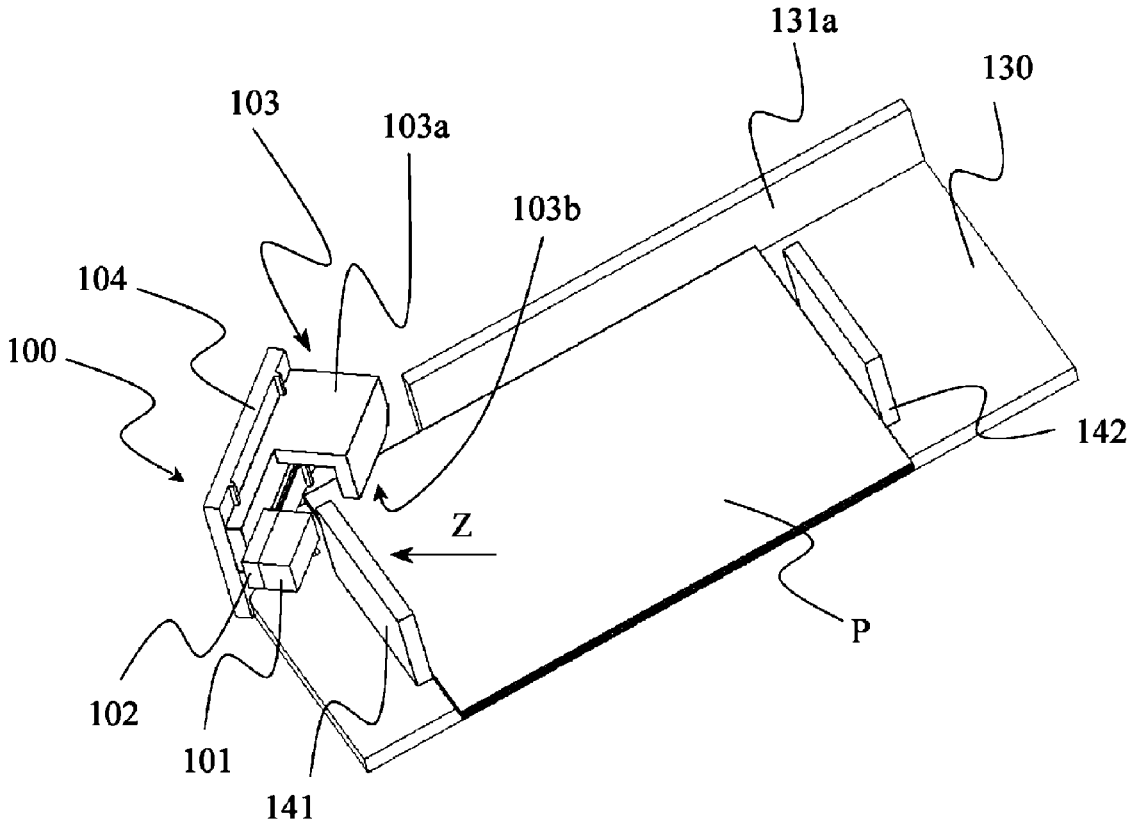
FIG. 9 is a perspective view for explaining a glue applying and pressing unit.

The knurling belt 190, as shown in FIGS. 6 to 7B, is formed to have a predetermined diameter such that a knurl 190*a* for antislip is formed on the entire circumference. The knurling belt 190 has such elasticity that the knurling belt 190 can be radially transformed, and is perfectly circular in general. The knurling belt 190 is winded on the discharge roller 7*a* on the processing tray 130 side between the first pair of discharge rollers 7 and rotationally supported. The floating roller 191 which floatedly rotates is in contact with the lower inner circumference of the knurling belt 190. In an operation of the lead-in paddle 160 and in the aligning operation of the width aligning device 140, the floating roller 191 operates. In particular, at a start of the width aligning operation of a sheet performed subsequently to a sheet leading operation of the lead-in paddle 160, the floating roller 191 is pulled to a support surface 131*a* side of the rear-end stopper member 131 by the tractive actuator M192. The knurling belt 190 is pulled to the downstream side of the sheet guide 130*d* by the floating roller 191 and transformed as shown in FIG. 8 not to disturb the sheet P from abutting on the rear-end stopper member 131. The tractive actuator M192 is controlled by the glue applying bookbinder control portion 410.

In FIG. 4, the lead-in paddle 160 is arranged on a drive shaft 161 arranged above the processing tray 130, and is rotated by a drive motor M160 to the left at a proper timing in FIG. 4. The length of the lead-in paddle 160 is set to be slightly longer than a distance from the drive shaft 161 to the upper surface 130*a* of the processing tray 130. A home position of the lead-in paddle 160 is a position indicated by a solid line where the lead-in paddle 160 does not disturb discharging of the sheet P from the first pair of discharge rollers 7 onto the processing tray 130.

When the lead-in paddle 160 is standby at the home position, the sheet P is discharged onto the processing tray 130. The lead-in paddle 160 rotates to the left to lead the sheet P discharged onto the processing tray 130, consequently, the rear edge of the sheet P until the rear edge abuts on the support surface 131*a* of the rear-end stopper member 131. Thereafter, the lead-in paddle 160 waits for a predetermined period of time and timely stops at the home position detected by a position sensor (not shown).

As shown in FIGS. 4 to 7A, the rear edge of the sheet P discharged from the first pair of discharge rollers 7 is guided to the lower side by the sheet guides 130*d* and falls on the processing tray 130. The sheet P slides on the processing tray 130 by the weight of the paper P, rotation of the lead-in paddle 160 (will be described later), and rotation of the knurling belt 190 until the paper P abuts on the support surface 131*a* of the rear-end stopper member 131.

The glue applying bookbinder control portion 410 controls the tractive actuator M192 such that the knurling belt 190 does not serve as a load when the sheet discharged onto the processing tray 130 is aligned in width by the width aligning device 140. More specifically, the knurling belt 190 is pulled to a right side in FIG. 6 by a predetermined length by means of the tractive actuator M192 to obtain a state in FIG. 7A, and the knurling belt 190 is retreated from the processing tray 130. In this manner, the width aligning device 140 can reliably align the sheet P in width as shown in FIGS. 6B to 7B.

In this case, the glue applying and pressing unit 100 will be described below with reference to FIGS. 9 to 12. As shown in FIGS. 9 to 12, the glue applying and pressing unit 100 is arranged at an upstream-side end of the processing tray 130 and a position near the first aligning member 141. The glue applying and pressing unit 100 has a glue applying and pressing portion 101 that applies a glue on sheets sequentially stacked on the processing tray 130 and presses the sheets to bond the sheets to each other by pressing. The glue applying and pressing portion 101 is rotationally supported by a glue applying and pressing support portion 102 and rotated and driven by a glue applying and pressing rotational motor M11 (see FIG. 10). Furthermore, the glue applying and pressing support portion 102 is supported by a glue applying and pressing support portion slide motor M12 (see FIG. 10) such that the glue applying and pressing support portion 102 can be moved on a first guide portion 103 in a direction almost parallel to the upper surface 130*a* of the upper surface 130*a*. More specifically, the glue applying and pressing portion 101 is arranged such that the glue applying and pressing portion 101 can move from a first standby position outside a sheet stacked on the processing tray 130 to a second standby position, different from the first standby position, outside the sheet through the upper surface of the sheet. In general, the glue applying and pressing support portion 102 is standby at a home position (first standby position) which is a position furthest from a sheet which is not in contact with stacked sheet as in FIG. 9. The home position of the glue applying and pressing support portion 102 is detected by a glue applying and pressing support portion home position sensor S2 (see FIG. 10). A stop position (second standby position) of the glue applying and pressing support portion 102 is detected by a glue applying and pressing support portion stop position sensor S3 (see FIG. 10).

The first guide portion 103 is supported by a guide elevating motor M13 (see FIG. 10) such that the first guide portion 103 can move on a second guide portion 104 in a direction almost vertical to the upper surface 130*a* of the processing tray 130. A home position of the first guide portion 103 is detected by a guide elevating position sensor S4 (see FIG. 10). In general, the first guide portion 103 is standby at a home position which is a position furthest from the processing tray 130 which is not in contact with stacked sheets. The first guide portion 103 includes a clamp portion 103*b* that applies a force to the sheet on the processing tray 130 toward the processing tray 130. The first guide portion 103 is supported by an elastic member (not shown) such that the first guide portion 103 is applied with a force by the elastic member and can appear with respect to a clamper stay 103*a*. A position of the clamp portion 103*b* is detected by a clamp position sensor S5 (see FIG. 10). The clamp position sensor S5 is a sensor that determines a stop position of the first guide portion 103 moving from the home position. When the clamp portion 103*b* is brought into contact with the sheet P stacked on the processing tray 130 and enters the sheet P by a predetermined length, the clamp position sensor S5 outputs a detection signal.

The glue applying and pressing portion 101 in the glue applying and pressing unit 100 will be described below. As shown in FIG. 12, the glue applying and pressing portion 101 integrally includes a glue applying portion 101*c* that applies a glue to sheets sequentially stacked on the processing tray 130 and pressing portions 101*a* and 101*b* that bond the glued part (bonding part) of the sheets on the processing tray 130 by pressure. The glue applying portion 101*c* is driven by a glue applying actuator M14 (see FIG. 10). A straight line connecting the pressing portions 101*a* and 101*b* is arranged to form an oblique angle with respect to the sheet surface. More specifically, the glue applying and pressing portion 101 is movably arranged such that the first standby position and the second standby position of the glue applying and pressing portion 101 are positions outside two sides forming one corner of the sheet P stacked on the processing tray 130.

Figure 10:
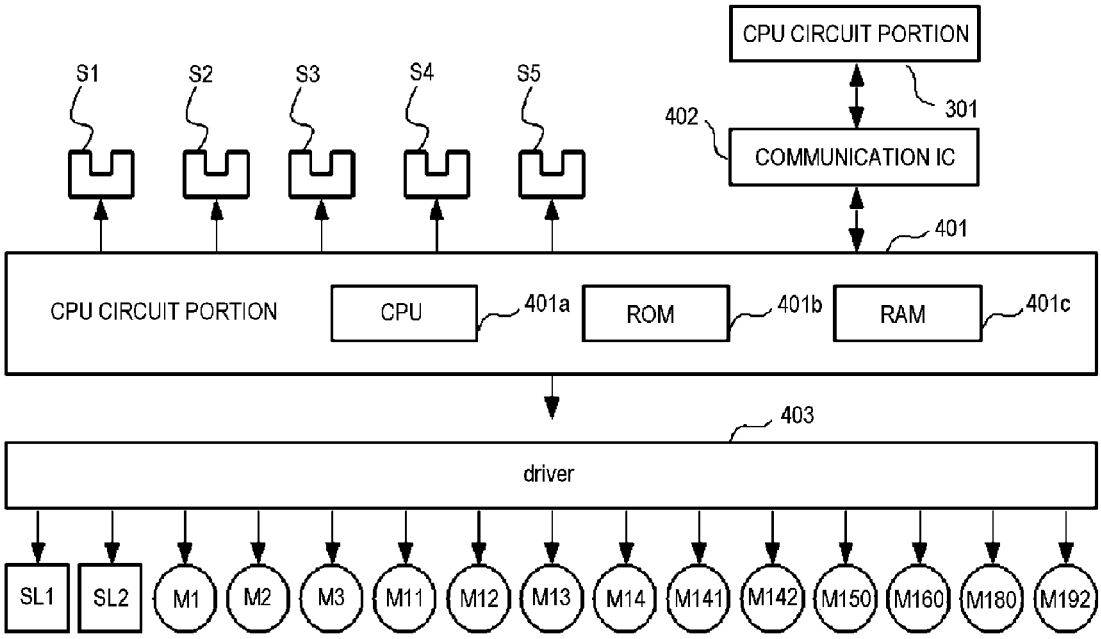
FIG. 10 is a block diagram illustrating a configuration of a glue applying bookbinder control portion.

FIG. 10 is a block diagram illustrating a configuration of the glue applying bookbinder control portion 410 which controls and drives the glue applying bookbinder 15.

The glue applying bookbinder control portion 410 has a CPU circuit portion 401 including a CPU 401*a*, a ROM 401*b*, and a RAM 401*c*. The CPU circuit portion 401 communicates with the CPU circuit portion 301 arranged on the image forming apparatus main body side through a communication IC 402 to perform data exchange. The glue applying bookbinder control portion 410 executes various programs stored in the ROM 401*b* on the basis of an instruction from the CPU circuit portion 301 to drive and control the glue applying bookbinder 15. In the embodiment, a configuration in that the glue applying bookbinder control portion 410 is mounted on the glue applying bookbinder 15 to exchange information with the CPU circuit portion 301 so as to drive and control the entire glue applying bookbinder 15 will be described below. The glue applying bookbinder control portion 410 may be mounted integrally with the CPU circuit portion 301 on the main body 6 of the image forming apparatus 1 to cause the main body 6 to directly control the glue applying bookbinder 15.

In the drive control, detection signals from various sensors are taken in the CPU circuit portion 401. As the various sensors, a glue applying bookbinding inlet sensor S1, the glue applying and pressing support portion home position sensor S2, the glue applying and pressing support portion stop position sensor S3, the guide elevating position sensor S4, an the clamp position sensor S5 are used.

A driver 403 is connected to the CPU circuit portion 401. The driver 403 drives the following motors, solenoids, and actuators on the basis of a signal from the CPU circuit portion 401.

In this case, as the motors, the inlet motor M1 serving as a drive source of the pair of inlet rollers 16, the buffer motor M2 serving as a drive source of the buffer roller 18, and the discharge drive motor M3 serving as a drive source of the second pair of discharge rollers 9 are used. Furthermore, the glue applying and pressing rotational motor M11 serving as a drive source of the glue applying and pressing portion 101, the glue applying and pressing support portion slide motor M12 serving as a drive source of the glue applying and pressing support portion 102, and the guide elevating motor M13 serving as a drive source of the first guide portion 103 are used. The glue applying actuator M14 serving as a drive source of the glue applying portion 101*c* is used. The first aligning motor M141 serving as a drive source of the first aligning member 141 and the second aligning motor M142 serving as a drive source of the pair of first and second aligning members 141 and 142 are used. The oscillating motor M150 serving as a drive source of the oscillating guide 150, the drive motor M160 serving as a drive source of the lead-in paddle 160, a bundle discharge motor M180 serving as a drive source of the pair of bundle discharge rollers 180, and the tractive actuator M192 serving as a drive source of the knurling belt 190 are used.

As the solenoids, a solenoid SL1 that switches the first switching member 11 and a solenoid SL2 that switches the second switching member 19 are used.

Figure 11:
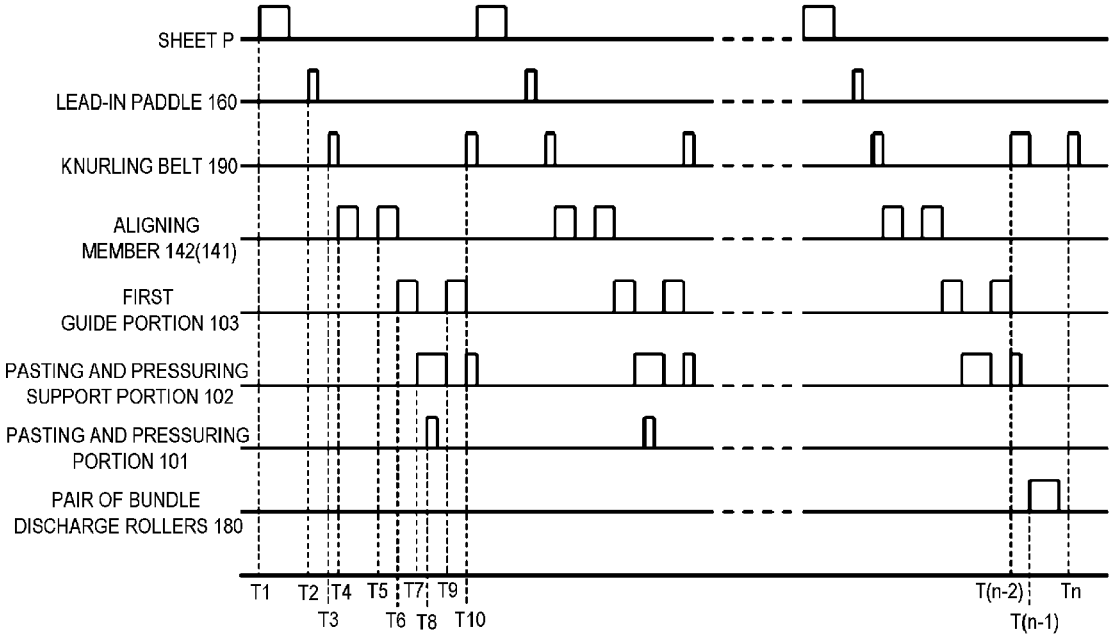
FIG. 11 is a time chart for explaining an operation of a bookbinder.

An operation of the glue applying bookbinder 15 will be described below with reference to the time chart shown in FIG. 11. When a first sheet is discharged by the first pair of discharge rollers 7 (T1), the first sheet is stacked on the processing tray 130 by an operation (T2) of the lead-in paddle 160 by the drive motor M160. The tractive actuator M192 pulls the knurling belt 190 from the projecting position to the retreat position (T3). When the knurling belt 190 moves to the retreat position, the aligning member 142 (141) aligns the sheet in width by the first aligning motor M141 and the second aligning motor M142, a forward operation (T4) and a backward operation (T5) are performed. Upon completion of a width aligning operation of the aligning member, the first guide portion 103 starts downward movement from the home position (T6). Thereafter, the first guide portion 103 receives a signal from the clamp position sensor S5 to stop, and the glue applying and pressing support portion 102 starts movement from the first standby position to the second standby position (T7). Furthermore, during movement of the glue applying and pressing support portion 102, the glue applying portion 101*c* glues the first sheet at a regulated timing (T8). When the glue applying and pressing support portion 102 receives a signal from the glue applying and pressing support portion stop position sensor S3 to stop at the second standby position, the first guide portion 103 starts upward movement (T9). When the first guide portion 103 receives a signal from the guide elevating position sensor S4 to stop, the tractive actuator M192 returns the knurling belt 190 to the projecting position (T10).

Thereafter, a second sheet is fed. When the second sheet is discharged to the first pair of discharge rollers 7, the second sheet is stacked on the first glued sheet on the processing tray 130 by an operation of the lead-in paddle 160. The knurling belt 190 is pulled from the projecting position to the retreat position. When the knurling belt 190 moves to the retreat position, the pair of first and second aligning members 141 and 142 (141) aligns the sheets in width. For this reason, a forward operation and a backward operation are performed. Upon completion of the width aligning operation of the aligning member, the first guide portion 103 starts downward movement from the home position. Thereafter, the first guide portion 103 receives a signal from the clamp position sensor S5 to stop, and the glue applying and pressing support portion 102 starts movement from the second standby position to the first standby position. Furthermore, during the movement of the glue applying and pressing support portion 102, the second sheet is pressed on the first glued sheet, and the glue applying portion 101*c* glues the second sheet at a regulated timing. When the glue applying and pressing support portion 102 receives a signal from the glue applying and pressing support portion home position sensor S2 to stop at the first standby position, the first guide portion 103 starts upward movement. When the first guide portion 103 receives a signal from the guide elevating position sensor S4 to stop, the tractive actuator M192 returns the knurling belt 190 to the projecting position.

As described above, the glue applying and pressing portion 101 integrally has the glue applying portion 101*c* and the pressing portions 101*a* and 101*b* reciprocally moves between the first standby position and the second standby position. The glue applying and pressing portion 101 can glue and press the sheets on the forward way and the backward way. When the glue applying portion 101*c* and the pressing portions 101*a* and 101*b* are designed to integrally move, other members may be used, and the glue applying portion 101*c* and the pressing portions 101*a* and 101*b* need not be integrally arranged as the glue applying and pressing portion 101. As an operation for the three and subsequent sheets, the same processes as the process for the first sheet and the process for the second sheet are sequentially performed.

When the last sheet is fed, the lead-in paddle 160 operates, and the tractive actuator M192 pulls the knurling belt 190 to the retreat position. The aligning member 142 (141) performs a forward operation and a backward operation. Thereafter, the first guide portion 103 moves downward and stops, and the glue applying and pressing support portion 102 moves and stops. Furthermore, the first guide portion 103 moves downward and stops, and the tractive actuator M192 pulls the knurling belt 190 to a bundle discharge position (T(n−2)). After the knurling belt 190 is completely separated from a sheet bundle, the oscillating guide 150 oscillates downward, the sheet bundle is nipped by the pair of bundle discharge rollers 180, and the sheet bundle is discharged onto the stack tray 199 by rotation (T(n−1)) of the pair of bundle discharge rollers 180. Finally, the tractive actuator M192 returns the knurling belt 190 to the projecting position (Tn).

The number of sheets stacked on the processing tray 130 is counted by the glue applying bookbinding inlet sensor (S1) shown in FIG. 2. When the number of sheets is equal to the number of sheets set and input by a user, the sheets are determined as finally stacked sheets, and the glue applying and pressing portion 101 does not apply a glue during the movement of the glue applying and pressing support portion 102. In this manner, the sheet bundle having the last sheet having a glued outer surface is formed and discharged onto the stack tray 199.

Operations of the glue applying and pressing portion 101 and the first guide portion 103 in the glue applying and pressing unit 100 will be described below in detail with reference to FIGS. 12 to 14. FIGS. 12 to 14 are diagrams obtained from a direction of arrow Z in FIG. 9.

Figure 12A:
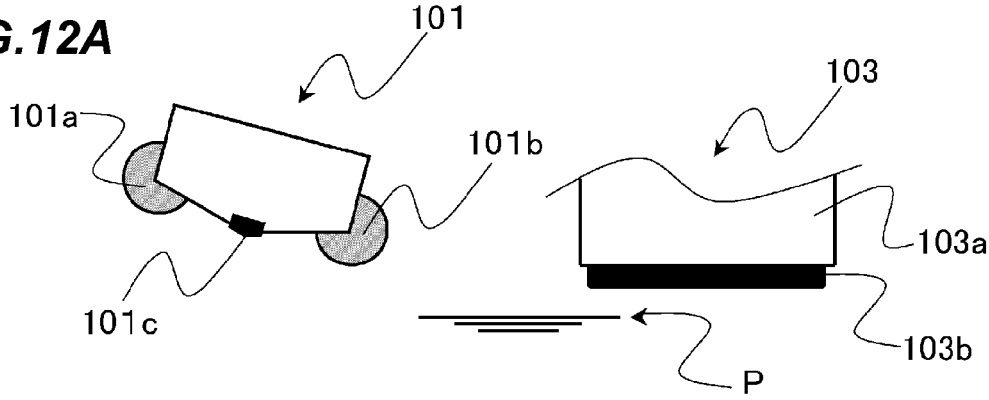
FIG. 12A to 12D are diagrams for explaining an operation of the glue applying and pressing unit.

FIG. 12A is a diagram illustrating a positional relationship between sheets P stacked on the processing tray 130 and aligned in width by the first and second aligning members 141 and 142 and the glue applying and pressing portion 101. The glue applying and pressing portion 101 and the first guide portion 103 are located above a sheet surface such that the first guide portion 103 is separated from the sheet P. The glue applying and pressing portion 101 is arranged to be located (first standby position) outside the sheet surface. The glue applying and pressing portion 101 is rotated with respect to the glue applying and pressing support portion such that the pressing portion 101*b* on the moving-direction downstream side of the glue applying portion 101*c* presses the sheet P.

Figure 12B:
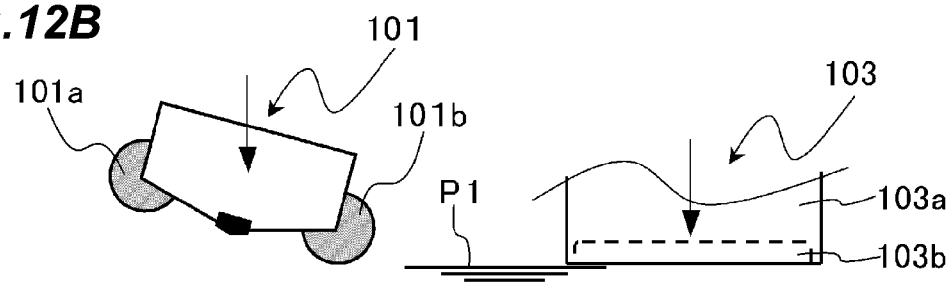

As shown in FIG. 12B, the glue applying and pressing portion 101 and the first guide portion 103 integrally move in such a direction that the glue applying and pressing portion 101 and the first guide portion 103 approach a sheet P1, and the clamp portion 103*b* is brought into contact with the sheet P1. In this state, when the glue applying and pressing portion 101 and the first guide portion 103 further move toward the sheet P1, the clamp portion 103*b* is pressed against the clamper stay 103*a*, and an operation of an elastic member (not shown) applies a predetermined force to the sheet P1.

Figure 12C:
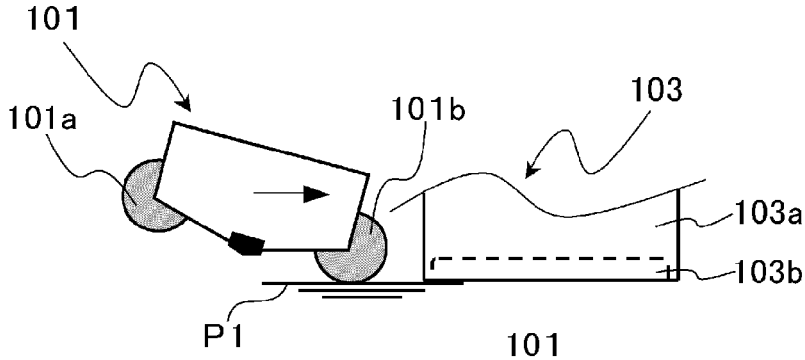
Figure 12D:
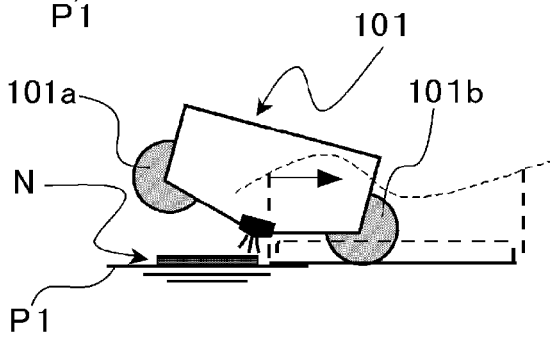

As shown in FIGS. 12C and 12D, the glue applying and pressing portion 101 moves from the outside (first standby position) of the sheet surface to a position above the sheet surface. At this time, the sheet P1 on which the pressing portion 101*b* on the moving-direction downstream side of the glue applying portion 101*c* is stacked is pressed, and the glue applying portion 101*c* further moves and forms a glue applying region N on the sheet surface at a predetermined position.

Figure 13A:
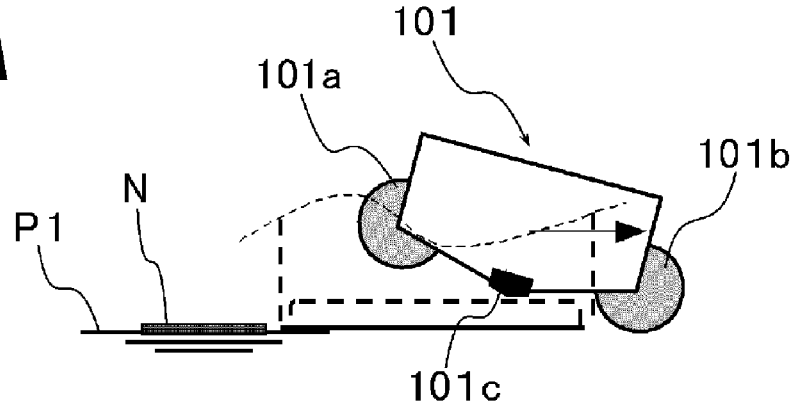
FIG. 13A to 13D are diagrams for explaining an operation of the glue applying and pressing unit.
Figure 13B:
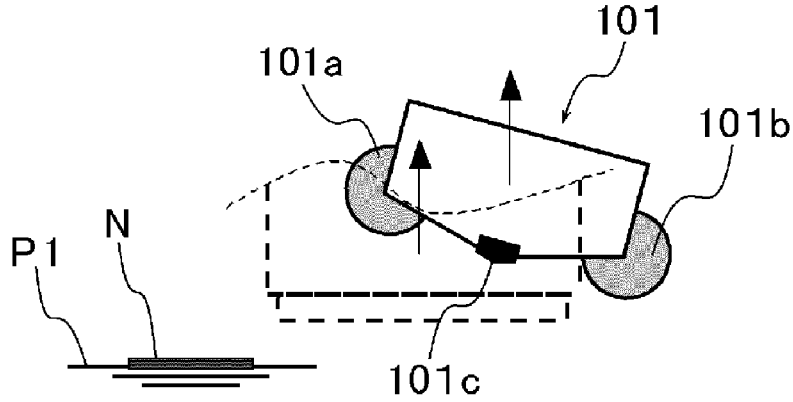

As shown in FIGS. 13A and 13B, the glue applying and pressing portion 101 moves to the outside (second standby position), different from the first standby position, of the sheet surface. Thereafter, the glue applying and pressing portion 101 moves and retreats upward to be separated from the sheet P1, and stops at a standby position before a sheet to be stacked next is received. In this operation, since the pressing portion 101*a* is located above the sheet and moves, the sheet surface is not pressed.

Figure 13C:
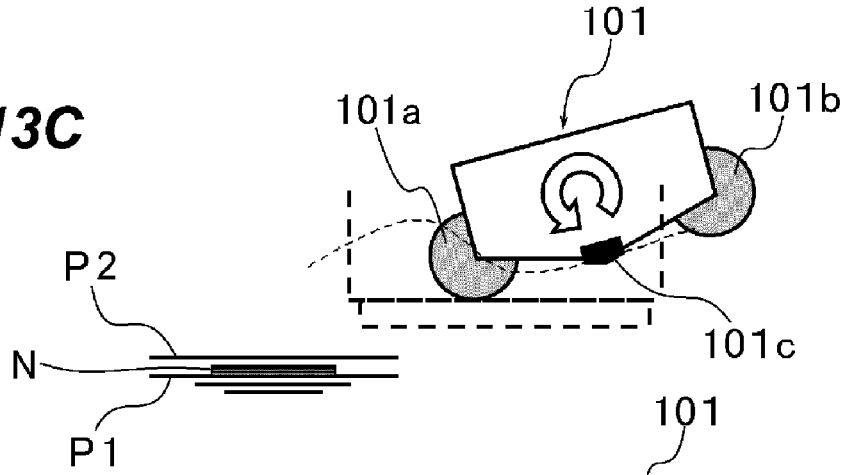

As shown in FIG. 13C, when a sheet P2 is stacked and aligned on the sheet P1 on which the glue applying region N, the glue applying and pressing portion 101 rotates in a direction of arrow in the drawing by the glue applying and pressing support portion and stops at a position to form a predetermined oblique angle with respect to the sheet surface. More specifically, the glue applying and pressing portion 101 is rotated with respect to the glue applying and pressing support portion such that the pressing portion 101*a* on the moving-direction downstream side of the glue applying portion 101*c* presses the sheet P2.

Figure 13D:
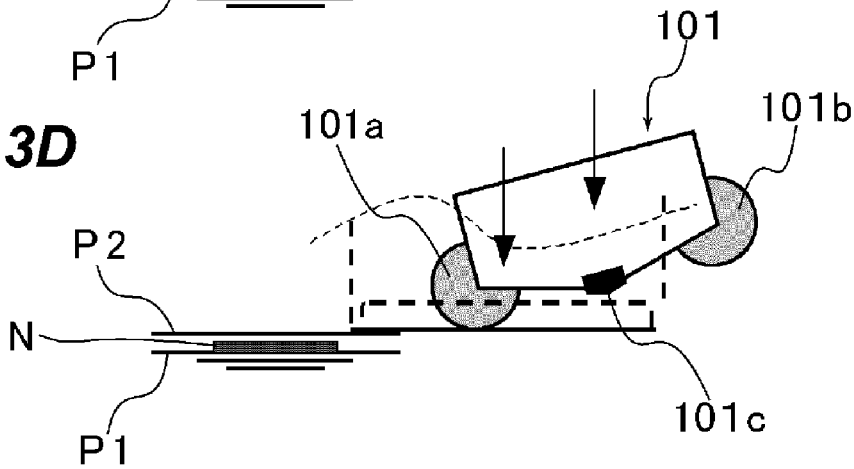

As shown in FIG. 13D, the glue applying and pressing portion 101 and the first guide portion 103 integrally move in such a direction that the glue applying and pressing portion 101 and the first guide portion 103 approaches the sheet P2, and the clamp portion 103*b* is brought into contact with the sheet. In this state, when the glue applying and pressing portion 101 and the first guide portion 103 further move toward the sheet, the clamp portion 103*b* is pressed against the clamper stay 103*a*, and an operation of an elastic member (not shown) applies a predetermined force to the sheet P2.

Figure 14A:
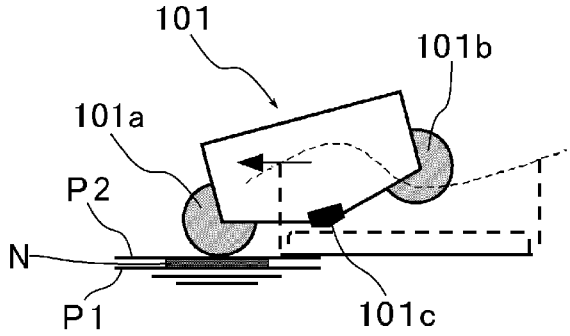
FIG. 14A to 14D are diagrams for explaining an operation of the glue applying and pressing unit.
Figure 14B:
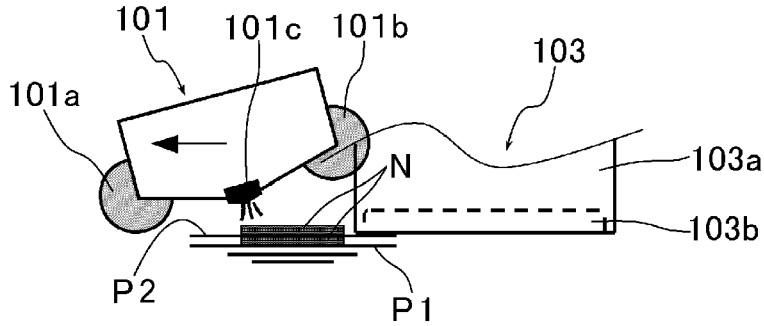

As shown in FIGS. 14A and 14B, the glue applying and pressing portion 101 moves from the outside (second standby position) of the sheet surface to a position above the sheet surface. At this time, the sheet P2 on which the pressing portion 101*a* on the moving-direction downstream side of the glue applying portion 101*c* is stacked is pressed, and the glue applying portion 101*c* further moves and forms a glue applying region N on the sheet surface at a predetermined position.

Figure 14C:
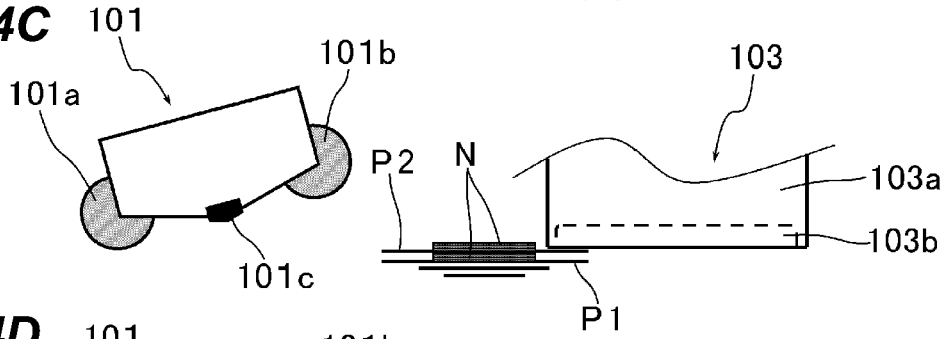
Figure 14D:
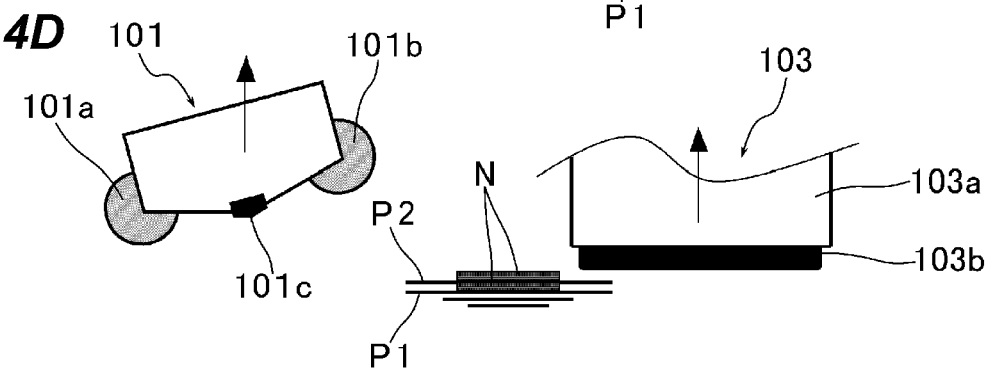

As shown in FIGS. 14C and 13D, the glue applying and pressing portion 101 moves to the outside (first standby position) of the sheet surface. Thereafter, the glue applying and pressing portion 101 moves and retreats upward to be separated from the sheet P2, and stops at a standby position before a sheet to be stacked next is received. At the operation timing, the glue applying and pressing portion 101 returns to the state in FIG. 12A. In this operation, since the pressing portion 101*a* is located above the sheet and moves, the sheet surface is not pressed.

The above operations are repeated times the number which is equal to the predetermined number of sheets of a sheet bundle, and a glued and pressed sheet bundle is formed. The uppermost sheet of the sheet bundle is subjected to only the pressing process without being subjected to the glue applying process. In this manner, the glue applying process and the pressing process are completed, and the formed sheet bundle is discharged onto the stack tray 199 by the pair of bundle discharge rollers 180.

As described above, according to the embodiment, the glue applying and pressing portion 101 obtained by integrating the glue applying portion 101*c* and the pressing portions 101*a* and 101*b* applies a glue on the sheet P on the processing tray 130 while moving and performs a pressing process to form a sheet bundle. For this reason, even though the number of sheets per bundle increases, a conveying length need not be increased, and a miniaturized sheet processing apparatus can be provided.

Any one, which is on the moving-direction downstream side of the glue applying portion 101*c*, of the pressing portions 101*a* and 101*b* integrated with the glue applying portion 101*c* presses the sheet. For this reason, a sheet pressing process can be performed together with the glue applying operation while preventing the applied glue from being pressed by the pressing portion.

The glue applying and pressing portion 101 obtained by integrating the glue applying portion 101*c* and the pressing portions 101*a* and 101*b* reciprocally moves between the first standby position and the second standby position, and can glue and press sheets on the forward way and the backward way. For this reason, processing times of glue applying and pressing can be shortened, and, consequently, a time required to form a sheet bundle subjected to the glue applying process and the pressing process can be shortened.

The embodiment illustrates the configuration in which the glue applying and pressing portion obtained by integrating the glue applying portion and the pressing portion can glue and press sheets on a forward way and a backward way between the first standby position and the second standby position. However, the present invention is not limited to the configuration. The glue applying and pressing portion may be able to glue and press sheets on any one of the forward way and the backward way between the first standby position and the second standby position. In this case, the pressing portion may press sheets on the moving-direction downstream side of the glue applying portion, and pressing portions need not be arranged on both the sides of the glue applying portion with respect to the moving direction. The glue applying and pressing portion is designed to be able to perform the glue applying and pressing processes on any one of the forward way and the backward way, so that a processing time is elongated. However, a switching operation for the pressing portion need not be performed depending on the switching operation of moving directions, and a simple structure can be achieved.

In the embodiment described above, the copying machine is illustrated as an image forming apparatus. However, the present invention is not limited to the copying machine. For example, another image forming apparatus such as a printer or a facsimile machine or another image processing apparatus such as a compound machine obtained by combining these functions may be used. The present invention is applied to a sheet processing apparatus used in these image forming apparatuses to enable to obtain the same effect as described above.

In the embodiment described above, the sheet processing apparatus detachably connected to the image forming apparatus is illustrated. However, the present invention is not limited to the embodiment. For example, a sheet processing apparatus integrally included in the image forming apparatus may be used, and the same effect can be obtained by applying the present invention to the sheet processing apparatus.

In the embodiment described above, the sheet processing apparatus used in the image processing apparatus is illustrated. However, the present invention is not limited to the embodiment. Any sheet processing apparatus that partially glues sheets and performs a pressing process to the sheets to form a sheet bundle may be used.

While the present invention has been described with reference to exemplary embodiments, its is to be understood that the invention is not limited to the disclosed exemplary embodiments. The scope of the following claims is to be accorded the broadest interpretation so as to encompass all such modifications and equivalent structures and functions.

The application claims the benefit of Japanese Patent Application No. 2007-142897, filed May 30, 2007, and No. 2008-131448, filed May 20, 2008, which are hereby incorporated by reference herein in their entirety.

What is claimed is:

1. A sheet processing apparatus, comprising:

a stacking portion on which sheets are stacked;

a conveying portion that conveys and stacks the sheets one by one onto the stacking portion;

a pressing portion comprising a first pressing member and a second pressing member that move and press the sheets;

a glue applying portion that moves integrally with the pressing portion and is disposed between the first and second pressing members, the glue applying portion applies a glue on the sheets one by one; and a controller that controls the pressing portion to move in a first direction and controls the first pressing member to press a bonding part of a first sheet stacked on the stacking portion, the controller also controls the glue applying portion while moving with the pressing portion to apply glue on the bonding part of the first sheet, then after a second sheet is subsequently stacked on the stacking portion, the controller controls the pressing portion to move in a second direction opposite to the first direction and controls the second pressing portion to press the second sheet on the bonding part of the first sheet on which glue has been applied, and the controller also controls the glue applying portion while moving with the pressing portion to apply glue on the second sheet.

2. The sheet processing apparatus according to claim 1, wherein the glue applying portion and the pressing portion are arranged such that the glue applying portion and the pressing portion can be moved from a first standby position outside the sheet stacked on the stacking portion to a second standby position outside the sheet through an upper surface of the sheet.

3. The sheet processing apparatus according to claim 1, wherein the pressing portion presses the sheets at downstream side of the glue applying portion in a moving direction of the glue applying portion.

4. The sheet processing apparatus according to claim 2, wherein the first and second pressing members are arranged on both the sides of the glue applying portion with respect to a moving direction of the glue applying portion, the glue applying portion and the pressing portion reciprocally move between the first standby position and the second standby position and can apply glue and press the sheets on a forward way and a backward way.

5. The sheet processing apparatus according to claim 2, wherein each time the glue applying portion and the pressing portion move to any one of the first standby position and the second standby position, the conveying portion conveys sheet onto glued sheets on the stacking portion one by one.

6. The sheet processing apparatus according to claim 5, wherein when the last sheet is conveyed, the glue applying portion does not apply a glue.

7. The sheet processing apparatus according to claim 2, wherein the first standby position and the second standby position are positions outside two sides which form one corner of a sheet stacked on the stacking portion.

8. An image forming apparatus comprising:

an image forming portion that forms an image on a sheet; and a sheet processing apparatus, the sheet processing apparatus including:

a stacking portion on which sheets are stacked;

a conveying portion that conveys and stacks the sheets one by one onto the stacking portion;

a pressing portion comprising a first pressing member and a second pressing member that move and press the sheets;

a glue applying portion that moves integrally with the pressing portion and is disposed between the first and second pressing members, the glue applying portion applies a glue on the sheets one by one; and a controller that controls the pressing portion to move in a first direction and controls the first pressing member to press a bonding part of a first sheet stacked on the stacking portion, the controller also controls the glue applying portion while moving with the pressing portion to apply glue on the bonding part of the first sheet, then after a second sheet is subsequently stacked on the stacking portion, the controller controls the pressing portion to move in a second direction opposite to the first direction and controls the second pressing portion to press the second sheet on the bonding part of the first sheet on which glue has been applied, and the controller also controls the glue applying portion while moving with the pressing portion to apply glue on the second sheet.

9. The image forming apparatus according to claim 8, wherein the glue applying portion and the pressing portion are arranged such that the glue applying portion and the pressing portion can be moved from a first standby position outside the sheet stacked on the stacking portion to a second standby position outside the sheet through an upper surface of the sheet.

10. The image forming apparatus according to claim 8, wherein the pressing portion presses the sheets at downstream side of the glue applying portion in a moving direction of the glue applying portion.

11. The image forming apparatus according to claim 9, wherein the first and second pressing members are arranged on both the sides of the glue applying portion with respect to a moving direction of the glue applying portion, the glue applying portion and the pressing portion reciprocally move between the first standby position and the second standby position and can apply glue and press the sheets on a forward way and a backward way.

12. The image forming apparatus according to claim 9, wherein each time the glue applying portion and the pressing portion move to any one of the first standby position and the second standby position, the conveying portion conveys sheet onto glued sheets on the stacking portion one by one.

13. The image forming apparatus according to claim 12, wherein when the last sheet is conveyed, the glue applying portion does not apply a glue.

14. The image forming apparatus according to claim 8, wherein the first standby position and the second standby position are positions outside two sides which form one corner of a sheet stacked on the stacking portion.

* * * * *